US006511062B1

(12) United States Patent
Blackwell et al.

(10) Patent No.: US 6,511,062 B1
(45) Date of Patent: Jan. 28, 2003

(54) PRESENTATION CONTROL FOR FLAT ARTICLE SINGULATION MECHANISM AND SENSORS SUITABLE FOR USE THEREWITH

(75) Inventors: Wayne M. Blackwell, Chenango Forks, NY (US); Michael D. Senger, Vestal, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/499,184

(22) Filed: Feb. 7, 2000

(51) Int. Cl.[7] ..... B65H 1/18
(52) U.S. Cl. ..... 271/153; 271/10.03; 271/150
(58) Field of Search ..... 271/10.03, 153, 271/150, 34, 152

(56) References Cited

U.S. PATENT DOCUMENTS

| | | | | | |
|---|---|---|---|---|---|
| 4,302,000 | A | * | 11/1981 | Frank | 271/150 |
| 4,509,735 | A | * | 4/1985 | Kosner | 271/150 X |
| 4,595,188 | A | * | 6/1986 | Wiley et al. | 271/150 X |
| 4,819,927 | A | * | 4/1989 | Noguchi et al. | 271/34 |
| 5,603,492 | A | * | 2/1997 | Mandel et al. | 271/58.09 |
| 5,839,015 | A | * | 11/1998 | Faguy et al. | 271/152 X |
| 5,957,448 | A | * | 9/1999 | Frank et al. | 271/152 |
| 6,032,946 | A | * | 3/2000 | Marshall et al. | 271/152 |
| 6,123,330 | A | * | 9/2000 | Schaal | 271/10.03 X |

* cited by examiner

*Primary Examiner*—Christopher P. Ellis
*Assistant Examiner*—Patrick Mackey
(74) *Attorney, Agent, or Firm*—Wolf, Greenfield & Sacks P.C.

(57) ABSTRACT

An apparatus and method are provided for controlling the presentation of articles to the singulation head of a system for singulating a stack of edge-mounted articles, for example mixed mail, which mechanism senses the instantaneous pressure at which the lead article of the stack is pressed against the singulation head. A feedback control may be provided responsive to a difference between detected instantaneous pressure and a desired target pressure for controlling at least one drive member in a manner so as to reduce such difference. Where there is a pick window of instantaneous pressure at which singulation can be effectively performed, a control may also be provided to inhibit operation of the singulation head when the instantaneous pressure is outside the pick window. Two vertically spaced pressure sensors may be provided on the singulation head to detect the angle at which the lead article is presented to the head and controls may be provided for the drive mechanism(s) to reduce the difference between the instantaneous angle detected and an optimum angle for singulation and/or to inhibit operation of the singulation head when the instantaneous angle is outside of a range where singulation may be effectively performed. The sensor preferably includes a lever extending from the surface of the singulation head which is moved by a distance dependant on the pressure applied thereto. A servo motor may be connected to the lever to apply a bias pressure thereto which bias pressure is determined by a control signal applied to the motor. The sensor may also include a position encoder generating an output indicative of lever position.

19 Claims, 5 Drawing Sheets

PRESENTATION CONTROL FOR FLAT ARTICLE SINGULATION MECHANISM AND SENSORS SUITABLE FOR USE THEREWITH

FIELD OF THE INVENTION

This invention relates to flat article singulation mechanisms and to sensors suitable for use therewith. More particularly, this invention relates to a mechanism for controlling the presentation of articles to a singulation head of a flat article singulation system and to sensors suitable for use in such a mechanism, which sensors detect the pressure at which an article is pressed against a surface with high precision and with easy range adjustability.

BACKGROUND OF THE INVENTION

There are many applications, including the processing of mixed mail, where a need exists to singulate a single flat article from a stack of such articles at relatively high speed and with wide variations in the size, thickness and weight of the articles being singulated, while still maintaining high controllability on the outputted articles, a low jam rate, low damage rate, and substantial elimination of doubles passing through the singulation mechanism. While many mechanisms exist for reducing the incidence of doubles passing from a singulation head to a takeaway mechanism, no such mechanism can be completely affective in catching and eliminating all doubles which occur, a doubles being defined as an article which sticks to an article being singulated and passes to the takeaway mechanism with such article. It is therefore desirable to design the singulation mechanism so as to minimize the incidence of doubles, and thus the number of doubles which must subsequently be resolved. However, while it has been generally understood that the occurrence of doubles can be reduced by controlling the presentation of the articles to the singulation head, there has been little understanding of exactly how to control such presentation so as to minimize doubles. Further, in order to control presentation of flat articles to the surface of the singulation head, it is necessary to accurately sense the pressure at which articles are being pressed against the head, preferably over a fairly wide pressure range. Suitable pressure sensors for such application have not heretofore existed.

SUMMARY OF THE INVENTION

In accordance with the above, it has been found that two factors in the presentation of flat articles, such as mixed mail, to a singulation head influence the incidence of doubles, these factors being the pressure at which the stack of articles is pressed against the head and the angle of the stack relative to the head. In particular, for a given singulation mechanism operating under selected specifications as to size, thickness and weight of the flat articles to be singulated, there will be a particular target pressure which is optimum for singulation without the incidence of doubles, and there will be a pick window of pressures around such target pressure at which singulation can be successfully performed. The further the instantaneous pressure of the lead article in the stack, the article to be singulated, against the singulation head deviates from the target pressure, the more likely it is that doubles will occur. When the pressure is outside of the pick window, successful singulation can no longer be assured. Similarly, there is an optimum angle of presentation for the articles in order to is achieve doubles free singulation, and there is a range of angles of presentation for articles beyond which successful singulation can not be assured. A successful singulation mechanism should therefore be designed so as to only be operable when the pressure at which articles are being pressed against the singulation head is within the pick window and when the angle of presentation is within a range at which successful singulation can be achieved. The singulation mechanism should also be designed to maintain the presentation pressure for the articles being singulated as close to the optimum target pressure as possible and to maintain the angle of presentation as close to a desired target angle as possible.

The invention thus provides a mechanism for controlling the presentation of articles to the singulation head of a system for singulating a stack of edge-mounted articles, which mechanism includes at least one servo-controlled drive member for moving the stack of articles toward the head, with a leading article of the stack, which article is to be singulated, contacting the head at an instantaneous pressure; a sensor mounted in the head for detecting such instantaneous pressure; and a feedback control operative in response to the difference between the detected instantaneous pressure and a target pressure for controlling the drive member so as to reduce such difference. For a preferred embodiment, such sensor is mounted in a lower portion of the head, and a second pressure sensor is also provided which is mounted in an upper portion of the head, the feedback control operating on the drive member in response to instantaneous outputs from at least the second pressure sensor, and generally from both pressure sensors, to control orientation of the stack of articles relative to the front face of the head. For a singulation head having a drive belt which picks off the leading article, the sensor and second sensor may be below and above the belt, respectively.

A second component may be provided for applying a controlled bias pressure to at least one of the sensors, such component being a servo motor for preferred embodiments, the bias pressure applied by the servo motor being determined by a control signal applied thereto. A separate servo motor is preferably provided for controlling bias pressure for each sensor. A separate position encoder may also be provided for each sensor, the position encoder preferably being a precision encoder which detects movement of a lever which moves in response to pressure applied thereto in the $10^{-3}$ range.

For a preferred embodiment, there are two servo-controlled drive members, a servo-driven belt on which an edge of each article rides and a servo-driven pusher on a back of the stack. The belt may for example respond primarily to an output from the sensor to control stack pressure against the head and may also be used to control orientation; the pusher may respond to both sensors to control orientation of the stack relative to the face of the head and to also control pressure. For some embodiments, the feedback control is operative to control the drive member at a rate which is related to the difference between instantaneous pressure and target pressure. For preferred embodiments, there is also a pick window of instantaneous pressures at which singulation can effectively be performed by the head, and a control is provided which inhibits operation of the head when the instantaneous pressure sensed by the sensor, or at least by the lower sensor where two sensors are employed, is outside of such pick window. The control inhibiting operation of the singulation head may also be operative where the angle of presentation is detected as being outside of an acceptable range.

The invention also includes a sensor for detecting the pressure at which an article is pressed against a surface, which sensor includes a lever extending from such surface, the lever being moved a selected distance in a selected direction in response to an article being pressed against the surface at pressures within a selected range, and a servo motor connected to the lever to apply a bias pressure thereto in a direction opposite the direction of lever movement under pressure from the article, the bias pressure being determined by a control signal applied to the motor. The sensor also includes, for preferred embodiments, a position encoder generating an output indicative of lever position in the selected direction. The position encoder is preferably a precision encoder capable of detecting movements of the lever in the $10^{-3}$ inch range.

Finally, the invention includes a method for controlling the presentation of articles to the singulation head of a system for singulating a stack of edge-mounted articles, the method including using a sensor mounted in the head to detect the instantaneous pressure at which a leading article in the stack, which article is to be singulated, is pressed against the head; determining the difference between each instantaneous pressure and a target pressure; and utilizing such difference to control at least one drive mechanism moving a stack of articles substantially perpendicular to a singulation face of the head in a manner so as to reduce such difference. There is preferably a pick window for the instantaneous pressure, the method including inhibiting operation of the singulation head during any period when the instantaneous pressure detected is outside of such pick window. A similar inhibiting operation may occur when the presentation angle of articles is outside of an acceptable range. For a preferred embodiment, there are two sensors, a first sensor mounted in a lower portion of the head and a second sensor mounted in an upper portion of the head, and there are two drive mechanisms, a first drive mechanism on which the edges of the articles ride and a second drive mechanism pushing on the back of the stack, the method for such embodiment including the steps of controlling at least the first drive mechanism in response to the difference detected at least by the first sensor to reduce such a difference; and controlling at least the second drive mechanism in response to pressure detected by both of the sensors to control orientation of the stack relative to the head and preferable to also control pressure. The drive mechanism may be controlled at a rate which is related to the difference between instantaneous and target pressure.

The foregoing in other objects, features and advantages of the invention will be apparent from the following more particular description of a preferred embodiment of the invention as illustrated in the accompanying drawings. Like reference numerals are used to refer to common elements in the various drawings.

IN THE DRAWINGS

DETAILED DESCRIPTION

Figure 1:
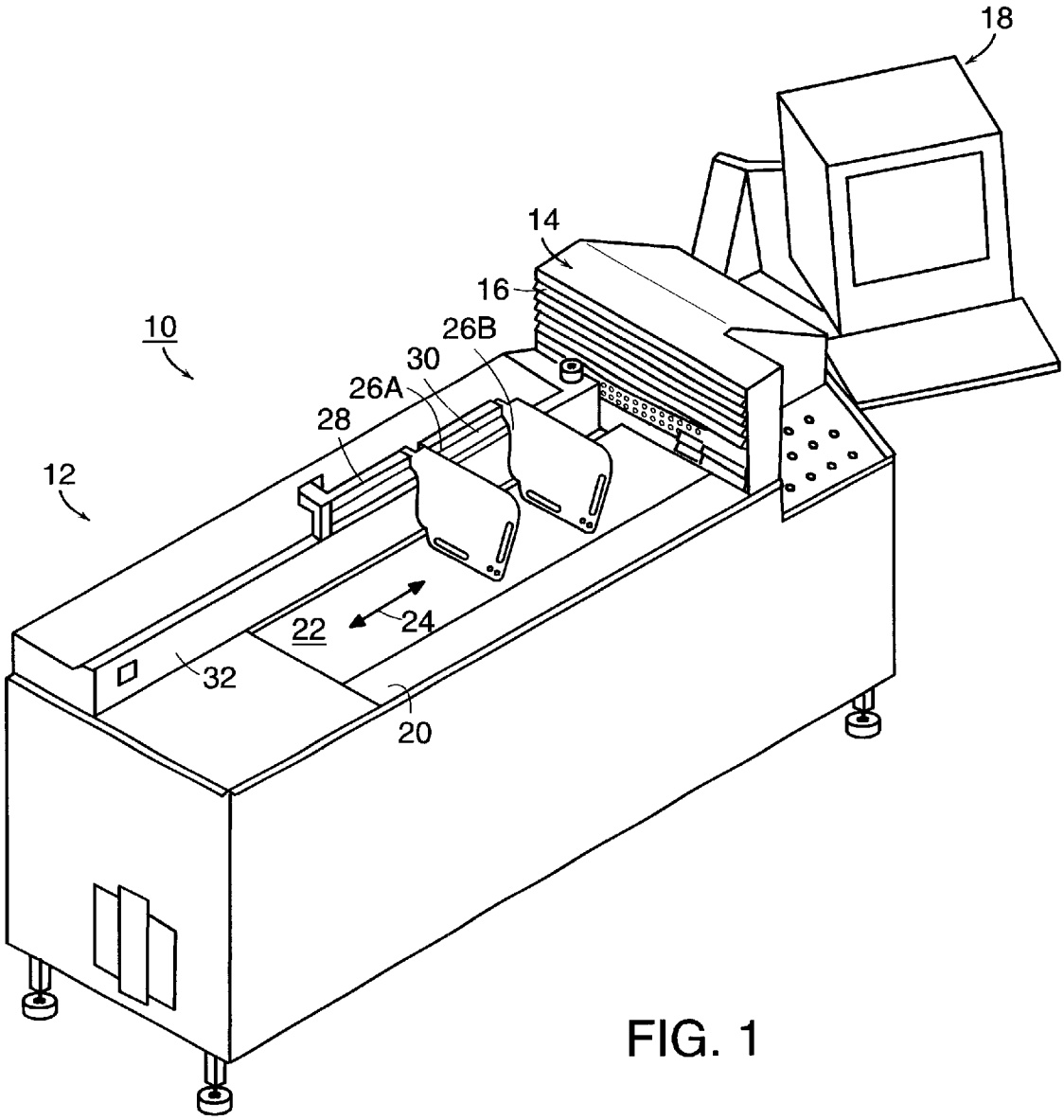
FIG. 1 is a perspective view of a mixed mail feeder machine of a type in which the teachings of this invention may be utilized.

FIG. 1 illustrates a mixed mail feeding machine 10 which is an example of one type of machine for which the teachings of this invention might be utilized. Machine 10 includes a mail feed mechanism 12, a singulation head 14, a takeaway mechanism 16, and a control is computer 18. While computer 18 for the illustrative embodiment is shown as being located at the machine 10 and as having a keyboard and a monitor, the control computer need not be located at machine 10; for example, several machines 10 could be controlled by a single separately located computer, or only a slave control could be located at the machine without input or output devices, the slave interfacing with a master computer.

Feeding mechanism 12 may be any of a variety of mechanisms suitable for delivering a stack of mixed mail under controlled pressure to singulation head 14. The illustrative mechanism shown in FIG. 1 includes a stacking table 20 having a rotating belt 22 thereon, belt 22 being driven in directions 24 by a servo motor to be discussed later. For a preferred embodiment, belt 22 passes over at least two rollers located at opposite ends of the belt, at least one of which rollers is driven by the servo motor under control of computer 18. A paddle or plate 26 is also shown extending upwards substantially perpendicular (i.e., preferably at a slight angle ≈4° back) to belt 22 and attached by an arm 28 to the housing of the mechanism 12 in a manner so that it may be pivoted away from belt 22. While two paddles 26A, 26B are shown in FIG. 1, for purposes of this invention only a single paddle 26 is required, and for purposes of the following discussion, it will be assumed that there is only a single paddle 26. A separate servo motor is provided for driving paddle 26 under control of computer 18 in a manner to be discussed later. While the movements of belt 22 and paddle 26 are independent, they are coordinated by processor 18. An indexing wall 32 is provided on the leading-edge side of table 20.

Figure 2:
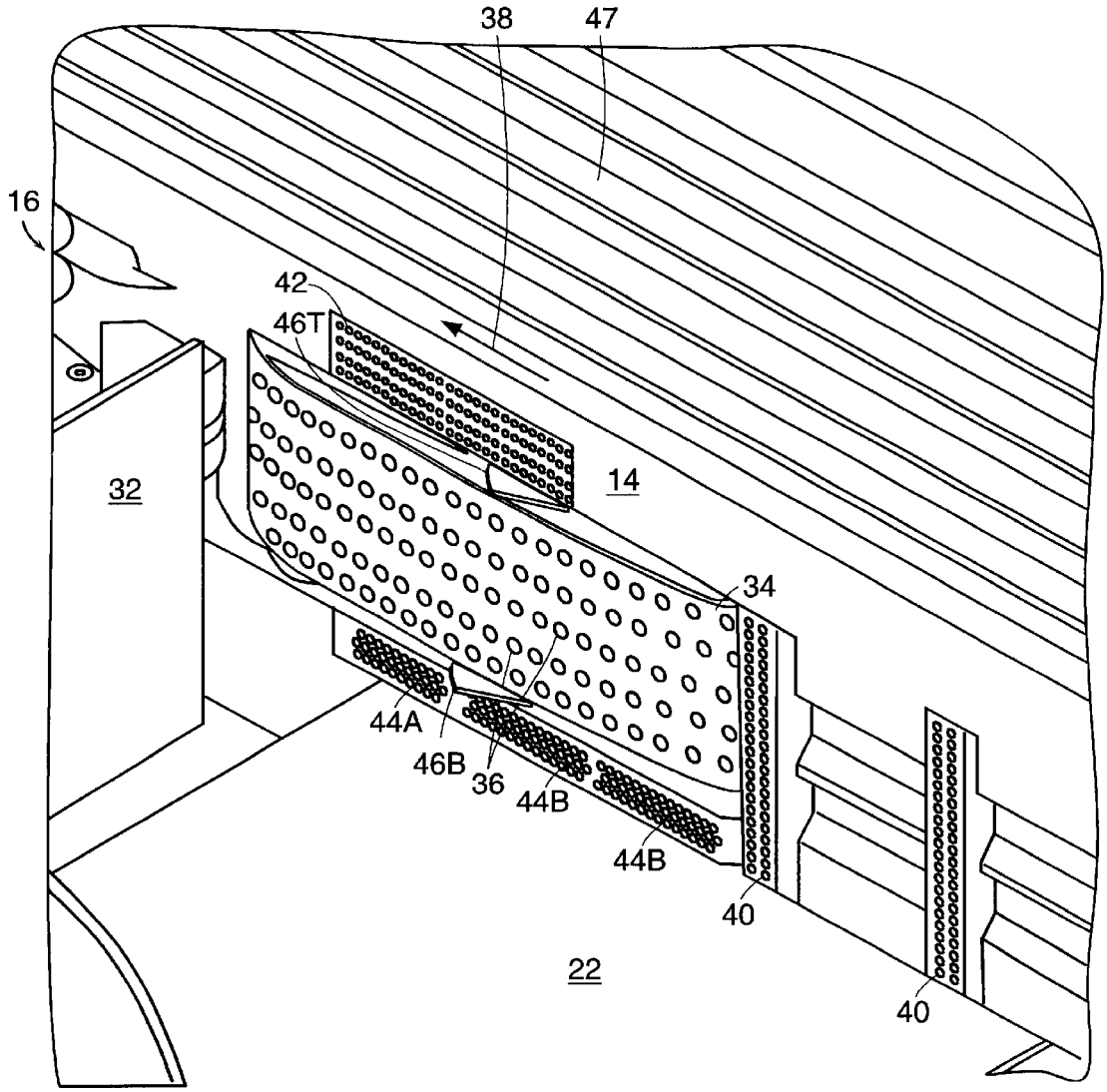
FIG. 2 is an enlarged perspective view of the front face of the singulation head for the machine shown in FIG. 1, which head includes sensors in accordance with the teachings of this invention.

FIG. 2 is an enlarged and more detailed view of singulation head 14 for a currently preferred embodiment. This head, which is discussed in greater detail in co-pending application Ser. No. 09/411,961, filed Oct. 4, 1999, includes a belt 34 of at least a low coefficient of friction material, and preferably a nearly friction free material (or at least having a low coefficient of friction substantially friction free outer mail-contacting surface) having perforations 36 formed therein, the belt being moved in the direction of arrow 38. The singulation head also has various vacuum heads 40, 42 and 44A, 44B for controlling positioning of the head and for assisting in doubles resolution. A lever 46T of a top pressured sensor and a lever 46B of a bottom pressure sensor are also shown, lever 46T being above belt 34 and lever 46B being below the belt.

Figure 5A:
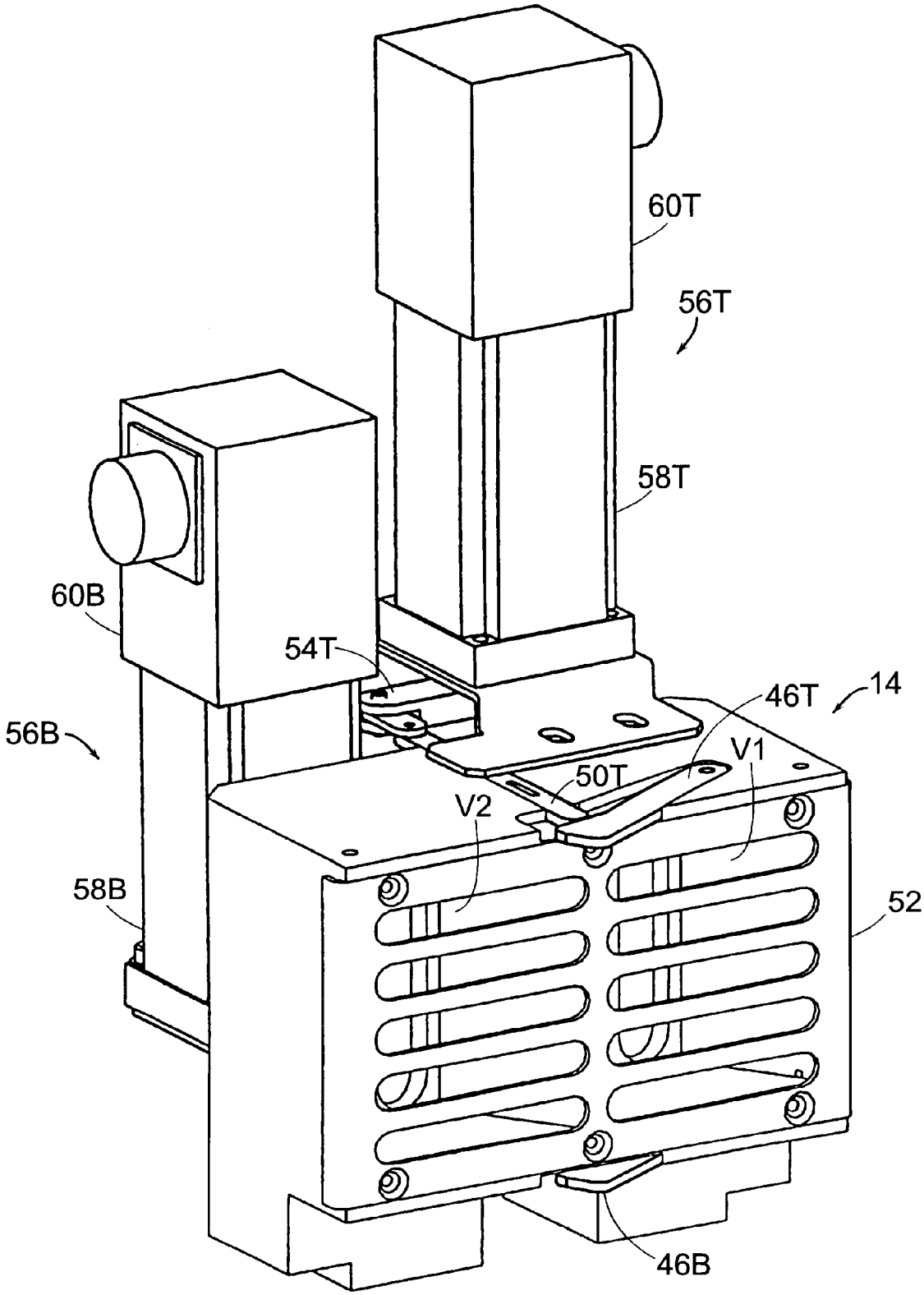
FIG. 5A is a front perspective view of a singulation head having a pair of sensors in accordance with the teachings of this invention.
Figure 5B:
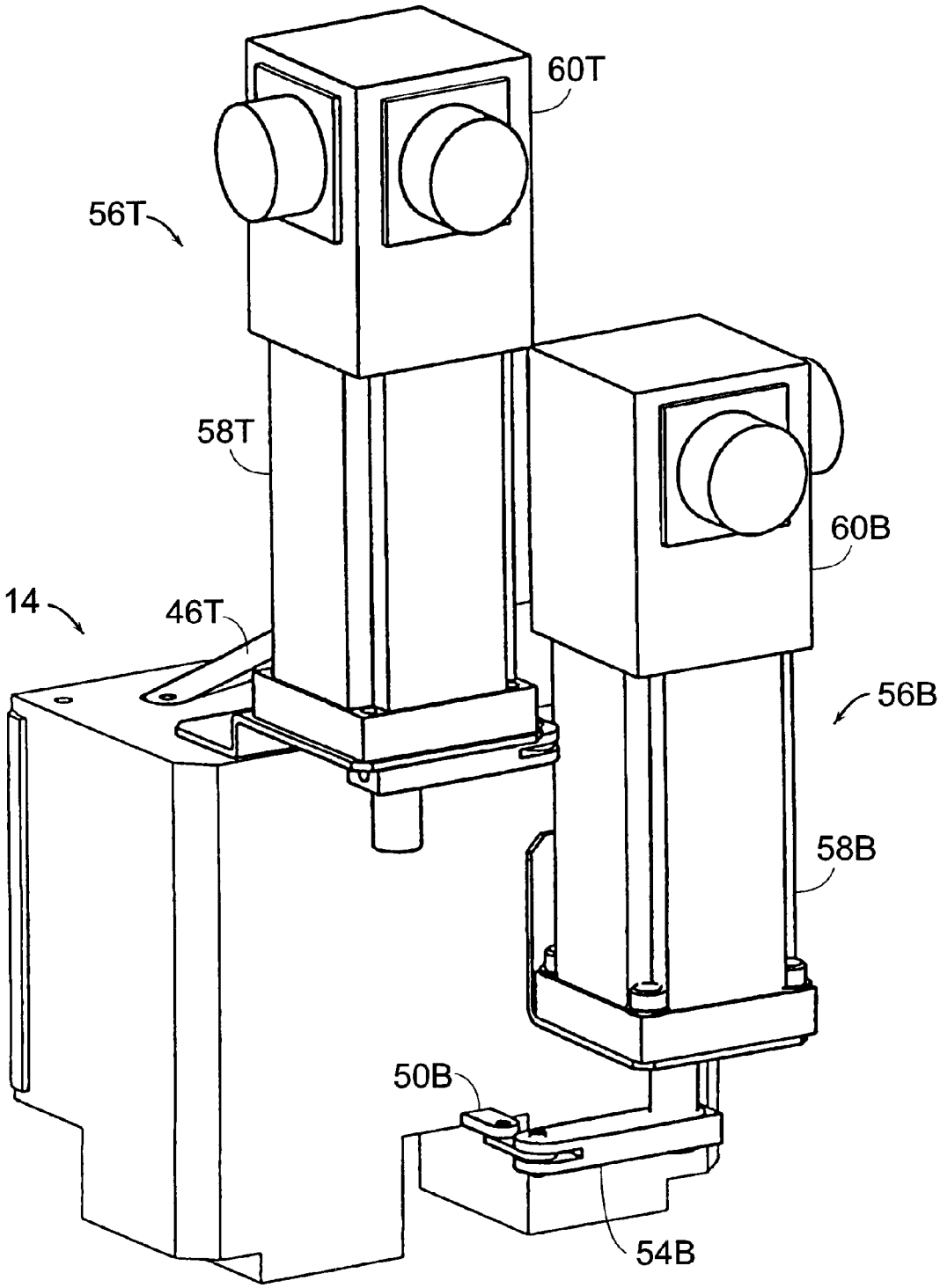
FIG. 5B is a rear perspective view of the head and sensors shown in FIG. 5A.

FIG. 5A illustrates singulation head 14 with the belt removed, the head having a pair of vacuum chambers V1 and V2, the function and operation of which are discussed in detail is the before mentioned co-pending application. From FIG. 5A it is seen that lever 46T bears against a plunger 50T which is constrained to move in a direction substantially perpendicular to the face 52 of singulation head 14. Plunger 50T is connected through a linkage mechanism 54T to rotate a shaft of sensor 56T, the sensor consisting of a position encoder 60T and a servo motor 58T. Similarly, referring particularly to FIG. 5B, lever 46B bears on a plunger 50B connected through a linkage 54B to rotate a shaft of a bottom sensor 56B, sensor 56B including a precision quaditure encoder 60B and a servo motor 58B.

Figure 4:
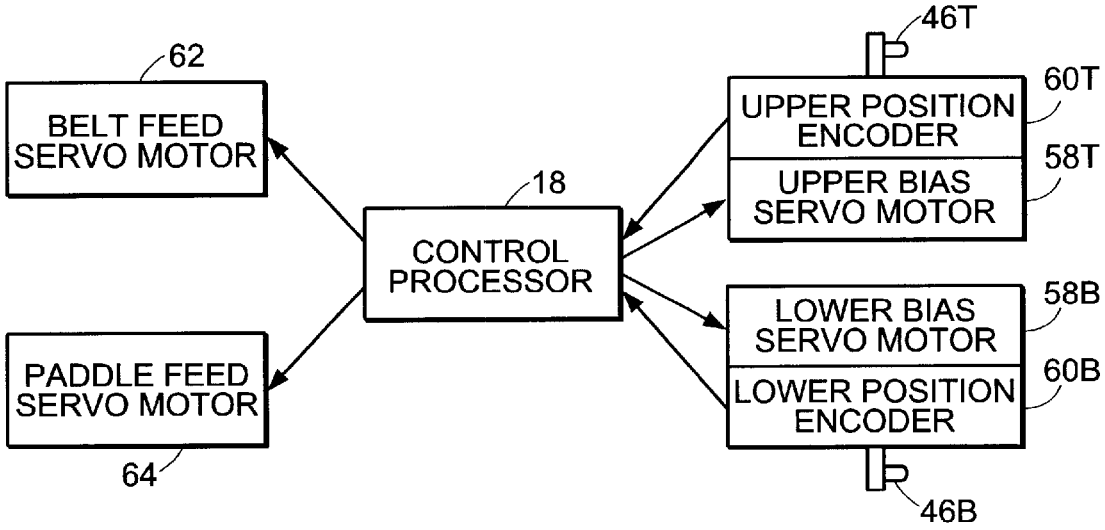
FIG. 4 is a schematic block diagram illustrating the interconnection of various components of the mechanism of this invention for an illustrative embodiment.

Referring to FIG. 4, it is seen that the angular position of top or upper position encoder 60T and the angular position of lower position encoder 60B are transmitted to control processor 18. The information transmitted from encoders 60 to control processor 18 may be in analog form and digitized at the processor or each encoder may include a digitizer. Since movement of each lever 54 in a direction perpendicular to face 52 of the singulation head is converted into a rotary motion by the corresponding linkage 54, the angular position of encoder 60 is, after calibration to be discussed later, indicative of the position of corresponding lever 46, and thus, as will be discussed later, of the pressure applied to the sensor. Processor 18 converts the angular positions applied thereto by each encoder into a corresponding pressure value.

While various biasing mechanisms, for example coil springs, might be used to apply a bias pressure to each lever 46, such biasing mechanisms are not precise, may not be uniform over the fill pressure range to be sensed and can not easily be adjusted to vary bias pressure depending upon application. Therefore, in accordance with the teachings of this invention, servo motors 58 are utilized to apply bias to each sensor shaft, and thus to the corresponding lever 46. The bias apply by a servo motor 58 is controlled by a signal, for example an amplified voltage, applied to the servo motor by control processor 18. The use of servo motors 58 to provide bias pressure for the sensors assures precise control of bias pressure, uniformity of the pressure over the fall sensing range and quick and easy control of the bias by merely changing the control voltage applied to the servo motor 58 by the control processor. With a precise bias pressure and a precise quadratic position encoder, movements of the lever 46 in the $10^{-3}$ inch range may be detected, providing a precise indication of the pressure applied to each sensor.

Control processor 18 also controls the operation of a servo motor 62 driving belt 22 and a paddle feed servo motor 64 moving paddle 26. For a preferred embodiment, belt 22 and paddle feed servo motor 64 may be moved in either direction 24, but this is not a limitation on the invention. The servo motors may each be stopped and started with times in the microsecond range.

Figure 3:
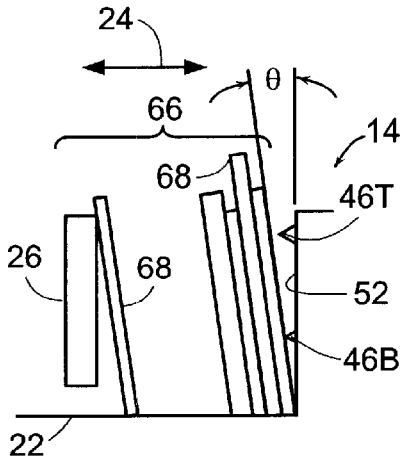
FIG. 3 is a semi diagrammatic side sectional view illustrating a stack of articles presented to a singulation head of the type utilized in practicing the teachings of this invention.

FIG. 3 illustrates a stack 66 of articles 68, for example mixed mail, which are held against face 52 of singulation head 14 by paddle 26 and are moved toward face 52 in direction 24 both by belt 22 and by paddle 26. The stack is shown as being at an angle θ to face 52 of the singulation head.

Operation

For a preferred embodiment, encoders 60 are incremental encoders and therefore need to be calibrated to provide an indication of absolute lever position. This can be accomplished by, for example, initially moving lever 46 for each of the sensors to its fully retracted or in position and indicating the position of the encoder under this condition as, for example, zero. The lever can then be moved to its fully extended position and the position of the encoder under this condition assigned an arbitrary number value, for example 198. Each click of the encoder can then be assigned some arbitrary value, each such click for example representing movement of $2\times10^{-3}$ inches for an illustrative embodiment. Other calibration procedures known in the art could also be utilized to the extent the encoder used is of a type requiring calibration.

A stack 66 of articles 68 may then be loaded against paddle 66 and servo motors 62 and 64 operated to move the stack in direction 24 toward face 52 of the singulations head. For a preferred embodiment, this movement may be done at a higher rate of speed until contact is made between the lead article of stack 66 and lever 46B, at which time the movement may be slowed. Movement then continues until the pressure against lever 46B is detected as being within the pick window for the machine. Processor 18 also compares the pressure against levers 46B and 46T to determine the angle θ. When processor 18 determines that the pressure against sensor 46B is within the pick window and that the angle θ is within an acceptable range, then a signal is sent to singulation head 14 to initiate singulation of articles 68.

While singulation is permitted when pressure on lever 46B is within the pick window and angle θ is within an acceptable range, the mechanism of this invention continues to operate in an effort to optimize these parameters and to therefore minimize the possibility of doubles occurring in the singulation process. In particular, so long as the detected pressure on lever 46B is different than an established target pressure, processor 18 operates at least servo motor 62, and to a lessor extent servo motor 64, speeding up or slowing down the servo motors, turning on or off the servo motors, or even reversing the direction of either one or both servo motors, as required, in order to control the pressure applied at sensor 46B so as to reduce the difference between the instantaneous pressure at this sensor and the target pressure. For a preferred embodiment, the rate at which the servo motors are operated to change the pressure applied by stack 66 to lever 46B varies in a way which is related to the magnitude of this difference. This variation may be substantially continuous, the rate dropping substantially uniformly as the difference decreases, or the variations may be in one or more steps.

Similarly, if the angle θ is too great so that, for example, there is no contact with sensor 46T, or if the stack topples forward so that pressure on sensor 46T is greater than pressure on lever 46B, singulation can not effectively be performed and operation of singulation mechanism 14 is inhibited (i.e., processor 18 does not operate the singulation head). However, even when θ is within an acceptable range for singulation, the system continues to monitor this angle and seeks to optimize it by controlled movement of belt 22 and/or paddle 26. For example, if stack 66 flops forward, paddle 26 may need to be moved backwards so as to permit the stack to flop over in the proper direction. However, so long as θ is different than an optimal value for this angle, servo motors 64 and 62 will be appropriately adjusted by processor 18 so as to adjust this angle in a direction to reduce the difference between the instantaneous angle and optimum angle. The rate at which these adjustments are made can, as for pressure, vary depending upon the amount of the difference.

While the invention has been described above with reference to a preferred embodiment, it is to be understood that this embodiment is being presented for purposes of illustration only and that, while for example, the use of servo motors for biasing is preferred for the reasons indicated, as is the use of the high precision quadrature encoders, for applications having lower precision requirements, other biasing and or encoding mechanisms known in the art might be utilized. Further, while a dedicated processor 18 has been shown in the Figures, the processor 18 utilized may be a general purpose processor used for controlling the system in general, the functions of processor 18 being described above being only part of the functions performed by the processor.

Alternatively, a special purpose processor may be provided for this purpose or the various control functions may be performed by some combination of hardware and software. Other mechanisms may also be substituted for belt drive 22 and paddle drive 26 and, for some applications, only one of these drives, for example, paddle drive 26, may be utilized. In addition, while both pressure and presentation angle are controlled for the preferred embodiment, in certain applications, only one of these functions may be actively controlled, for example, pressure. Finally, while the invention has been discussed primarily with respect to a mixed mail singulation application, the invention is not limited to this application and may be utilized either at other appropriate locations in a mixed mail processing system or in other applications involving the handling/separation singulation of substantially flat articles. Thus, while the invention has been shown and described above with respect to a preferred embodiment, the foregoing and other changes in form and detail may be made therein by one skilled in the art while still remaining within the spirit and scope of the invention which is to be defined only by the appended claims.

What is claimed is:

1. In a system for singulating a stack of edge mounted articles by use of a singulation head, a mechanism for controlling the presentation of articles to the head including:

at least one servo-controlled drive member for moving said stack of articles toward said head with a leading article of said stack, which article is to be singulated, contacting said head at an instantaneous pressure;

a sensor mounted in said head for detecting said instantaneous pressure; and a feedback control operative in response to a difference between the detected instantaneous pressure and a target pressure for controlling said drive member so as to reduce said difference.

2. A mechanism as claimed in claim 1, wherein said sensor is mounted in a lower portion of said head, and including a second pressure sensor mounted in an upper portion of said head, said feedback control operating said at least one drive member in response to instantaneous outputs from at least said second pressure sensor to control orientation of said stack of articles relative to a front face of said head.

3. A mechanism as claimed in claim 2, wherein said feedback control operates in response to instantaneous outputs from both said sensor and said second pressure sensor to control orientation.

4. A mechanism as claimed in claim 2, wherein said head has a drive belt which picks off said leading article, and wherein said sensor and said second sensor are below and above said belt, respectively.

5. A mechanism as claimed in claim 2, including a separate component applying a controlled bias pressure to at least one of said sensor and second sensor.

6. A mechanism as claimed in claim 5, wherein each said component is a servo-motor, bias pressure being determined by a control signal applied to the motor.

7. A mechanism as claimed in claim 5, wherein there is a servo-motor controlling bias pressure for each sensor.

8. A mechanism as claimed in claim 5, including a separate position encoder for each of said sensors.

9. A mechanism as claimed in claim 8, wherein each said position encoder is a precision encoder, each of said sensors including a lever which moves in response to pressure applied thereto, said encoder detecting movement of said lever in the $10^{-3}$ inch range.

10. A mechanism as claimed in claim 2, wherein there are two servo-controlled drive members, a servo-driven belt on which said edge of the articles ride and a servo-driven pusher on a back of said stack.

11. A mechanism as claimed in claim 1, including a component applying a controlled bias pressure to said sensor.

12. A mechanism as claimed in claim 11, wherein said component is a servo-motor, bias pressure being determined by a control signal applied to the motor.

13. A mechanism as claimed in claim 11, including a position encoder for said sensor.

14. A mechanism as claimed in claim 13, wherein said position encoder is a precision encoder, said sensors including a lever which moves in response to pressure applied thereto, said encoder detecting movement of said lever in the $10^{-3}$ inch range.

15. A mechanism as claimed in claim 1, wherein said feedback control is operative to control said drive member at a rate which is related to said difference.

16. A mechanism as claimed in claim 1, wherein there is a pick window of instantaneous pressures at which singulation can effectively be performed by said head, and including a control which inhibits operations of said head when the instantaneous pressure sensed by said sensor is outside said pick window.

17. A mechanism as claimed in claim 1 wherein there is an orientation range for said articles at which singulation can effectively be performed, and including a control which inhibits operations of said head when article orientation is outside said range.

18. In a system for singulating a stack of edge mounted articles by use of a singulation head, a mechanism for controlling the presentation of articles to the head including:

at least one servo-controlled drive member for moving said stack of articles toward said head with a leading article of said stack, which article is to be singulated, contacting said head at an instantaneous pressure;

a sensor mounted in said head for detecting said instantaneous pressure; and a control which inhibits operations of said head when the instantaneous pressure sensed by said sensor is outside a pick window of instantaneous pressures at which singulation can be effectively performed by said head.

19. A mechanism as claimed in claim 18 wherein there is an orientation range for said articles at which singulation can effectively be performed, and including a control which inhibits operations of said head when article orientation is outside said range.

* * * * *